US008096330B2

(12) United States Patent
Mazzon

(10) Patent No.: US 8,096,330 B2
(45) Date of Patent: Jan. 17, 2012

(54) ISOBARIC ROTARY FILLING MACHINE FOR FILLING CONTAINERS WITH LIQUIDS

(75) Inventor: Giovanni Mazzon, San Bonifacio (IT)

(73) Assignee: MBF S.p.A, Veronella (VR) (IT)

( * ) Notice: Subject to any disclaimer, the term of this patent is extended or adjusted under 35 U.S.C. 154(b) by 1210 days.

(21) Appl. No.: 11/879,946

(22) Filed: Jul. 19, 2007

(65) Prior Publication Data

US 2008/0083474 A1 Apr. 10, 2008

(30) Foreign Application Priority Data

Oct. 4, 2006 (IT) ..... PD2006A0365

(51) Int. Cl.
*B65B 1/04* (2006.01)

(52) U.S. Cl. ..... 141/91; 141/144; 141/147

(58) Field of Classification Search ..... 141/57, 141/89–92, 144–147
See application file for complete search history.

(56) References Cited

U.S. PATENT DOCUMENTS 4,207,932 A * 6/1980 Gilmour ..... 141/90
4,295,503 A * 10/1981 Gilmour ..... 141/90
5,941,290 A * 8/1999 Vaughn, Jr. ..... 141/90
6,079,460 A * 6/2000 Ballan et al. ..... 141/145
7,143,793 B2 * 12/2006 Vaughn, Jr. ..... 141/89
7,341,079 B2 * 3/2008 Zanga ..... 141/92
7,866,355 B2 * 1/2011 Quetel et al. ..... 141/147

FOREIGN PATENT DOCUMENTS

EP 0 568 121 A 11/1993
EP 0 919 517 A 6/1999
FR 2 067 499 A 8/1971

OTHER PUBLICATIONS

European Search Report.

* cited by examiner

*Primary Examiner* — Timothy L Maust
(74) *Attorney, Agent, or Firm* — Collard & Roe, P.C.

(57) ABSTRACT

Isobaric rotary filling machine for filling containers, has a rotating table supporting a pressurized tank and valve units. Each valve unit has a filling duct for supplying the liquid from the tank to the containers, regulated by a faucet, and an air return pipe associated with a shut-off valve for controlling the pressure balance between the container and the tank. A flushing station, operationally associated with but fixed relative to the rotating table, has a receiving tray connected to a flushing circuit and operable to move between a non-operative position situated outside the travel path of the valve units, and an operative position situated underneath the travel path. The faucets and the shut-off valves open each filling duct and each pipe when the receiving tray is in the operative position and the flushing circuit is connected to the supply line of the tank.

10 Claims, 7 Drawing Sheets

ISOBARIC ROTARY FILLING MACHINE FOR FILLING CONTAINERS WITH LIQUIDS

The present invention relates to an isobaric rotary filling machine for filling containers with liquids.

The machine in question is intended to be used in the bottling industry for filling containers, in particular bottles, with gaseous liquids, i.e. liquids containing carbon dioxide, for example gaseous beverages such as fizzy wine, mineral water, beer, etc.

According to the conventional art, the machine is provided with a rotating table or carousel having, peripherally mounted thereon, a plurality of valve units for filling the containers which are positioned underneath during their travel from the entry point to the outlet of the machine.

The machine is also provided with a tank for storing the liquid to be bottled, which is kept at a pressure higher than atmospheric pressure and is connected to a supply line able to replenish it with the liquid which is transferred to the valve units for filling the containers.

Each valve unit has an obturator or faucet which regulates the flow of the liquid into the container, usually a glass or PET bottle, when the latter is arranged coaxially underneath the valve unit.

The obturator is mounted inside a tubular duct of the valve unit which connects the liquid storage tank to the containers. Bottling with isobaric filling machines allows the liquid to be introduced into the container while keeping its pressure unchanged.

The valve unit also has an air return pipe which is mounted inside the duct and balances the pressure inside the container also during descent of the liquid.

The bottom part of this pipe also normally has the function of adjusting, for example hydraulically or by means of a probe, the maximum level of the liquid inside the container, upon reaching of which the flow of the liquid to the container must be interrupted hydraulically by closing the obturator.

As is known, isobaric filling machines require frequent flushing.

The greater complexity of isobaric filling machines compared to machines operating by means of gravity or under a slight vacuum results in a greater difficulty in the operations to be performed for complete flushing of the machine.

Moreover, the large number of pipes which have to be flushed, such as, for example, the gas-release pipe, have hitherto made the flushing operations even more problematic.

These flushing operations must be performed for several reasons.

A first reason consists in the fact that cleaning of all the machine parts, and in particular the valve units, which come into contact with the liquid to be bottled, must be performed periodically in order to keep the bacterial content as low as possible.

This requirement arises in particular whenever a production cycle terminates and before the resumption of a new cycle. Stoppage may be envisaged, for example, for maintenance of the machine or for a temporary interruption in the working activity.

A second reason consists in the need to change the bottling product and therefore clean the machine in order to avoid contamination between different liquids. As a result of this operating requirement all the product from the previous production cycle must be discharged before starting a new cycle. The product change-over is frequently carried out by discharging the previous liquid still present in the valve units directly onto the bottle support discs and onto other mechanical parts of the machine, resulting in general soiling which reduces the working life of the machine and also prevents the observance of proper hygienic conditions.

The flushing operations require circulation of a flushing fluid (mostly consisting of suitable aqueous solutions) inside all the pipes where the liquid passes and where the air or inert gas passes.

At present, the system which is most used for performing flushing in isobaric machines envisages the use of auxiliary containers—referred in the technical jargon of the sector as "dummy bottles"—which allow opening of the individual valve units and execution of a closed cycle by means of which the flushing fluid is circulated.

These auxiliary containers are mounted, for this purpose, underneath each valve unit so as to be able to open the obturators and allow the recirculation of the flushing fluid inside a closed circuit which supplies the duct of the valve units and the air return pipe.

This flushing system of the known type involves long manual operations in order to mount the auxiliary containers on each valve unit and does not allow automatic programming for carrying out the flushing cycles.

More recently, machines able to perform automatically insertion of the auxiliary containers underneath the valve units have become more widespread. In this way it is possible to perform a CIP washing cycle with the circuit closed and with automatic insertion and extraction of the auxiliary containers.

Likewise these automatic machines, although improving the performance of manually set-up machines, have certain drawbacks.

Firstly they involve particularly high costs since it is required to perform the installation of auxiliary containers for all the valve units.

Moreover, they have the drawback that, once the flushing cycle has been terminated, they discharge freely onto the bottle support discs the flushing fluid which is present in each valve unit.

This fact obviously results in the loss of a considerable amount of flushing fluid and in particular in contamination of the machine with the said fluid.

Moreover, with these machines also, whenever it is required to discharge the liquid being used in order to change the filling product, the same problem of having to discharge freely onto the machine that part of the liquid present in the valve units and unable to be recycled into the tank arises.

Opening of the faucets in order to discharge the liquid is performed on most occasions manually and therefore requires the use of an operator, resulting in considerable amount of lost time and expense.

The problem underlying the present invention is therefore to overcome the drawbacks of the machines of the known type by providing an isobaric rotary filling machine which allows the automatic flushing of all its parts to be performed easily and in a cost-effective manner.

A further object of the present invention is to provide a machine which is constructionally simple and operationally entirely reliable and does not involve free discharging of the flushing liquid left inside each valve unit in order to perform flushing.

A further object of the present invention is to provide a machine which allows the bottling product to be changed rapidly and automatically, without free discharging of the liquid from the previous bottling cycle.

Another object of the machine in question to provide a machine, the valve units of which are able to initiate filling of the containers without sudden start-ups.

These and other objects are all achieved by the isobaric filling machine according to the accompanying claims.

The technical features of the invention, in accordance with the abovementioned objects, may be clearly determined from the contents of the claims indicated below and the advantages thereof will emerge clearly from the detailed description which follows, provided with reference to the accompanying drawings which show a purely exemplary and non-limiting embodiment in which:

Figure 1:
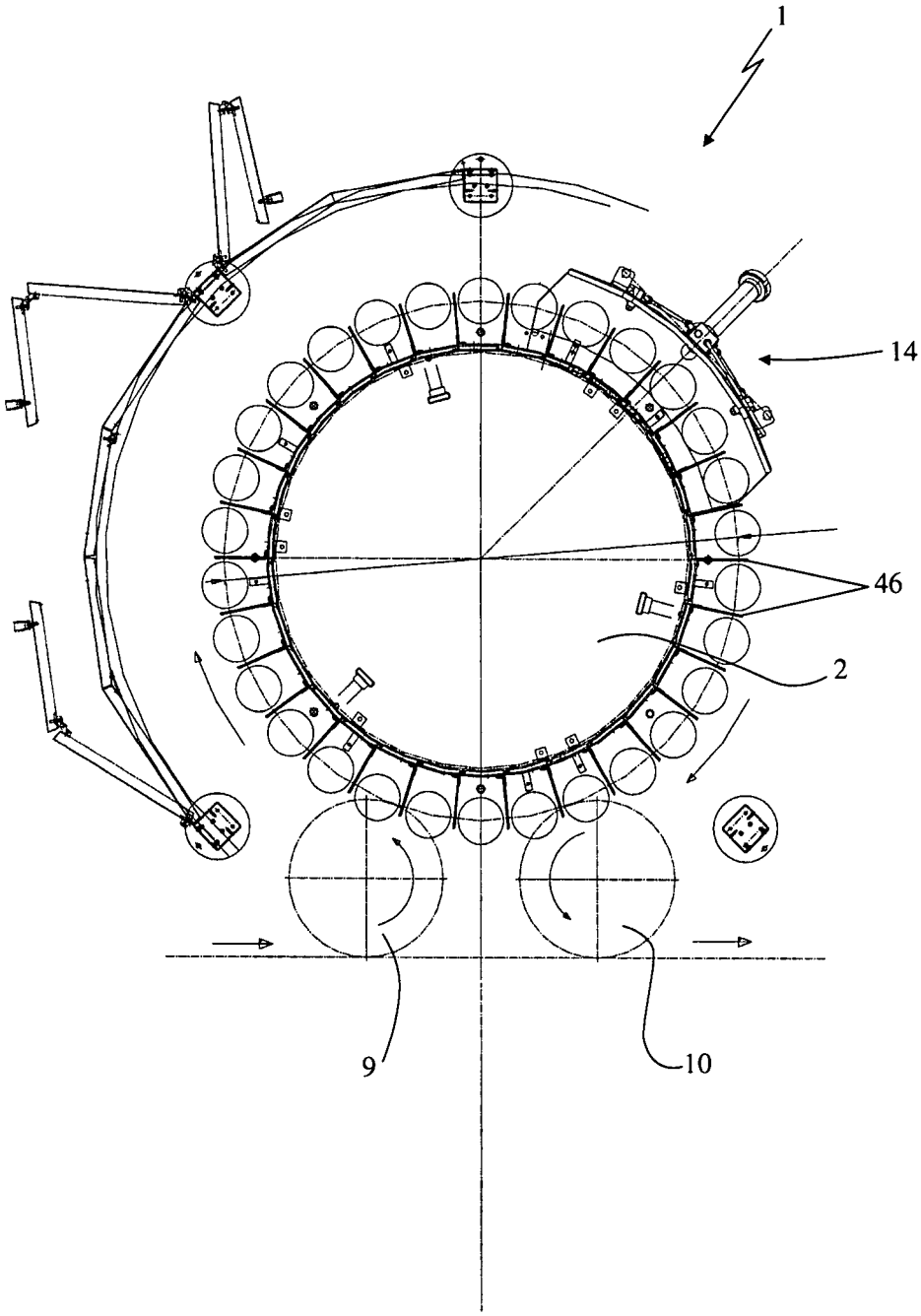
FIG. 1 shows a schematic plan view of the isobaric rotary filling machine according to the present invention.
Figure 2:
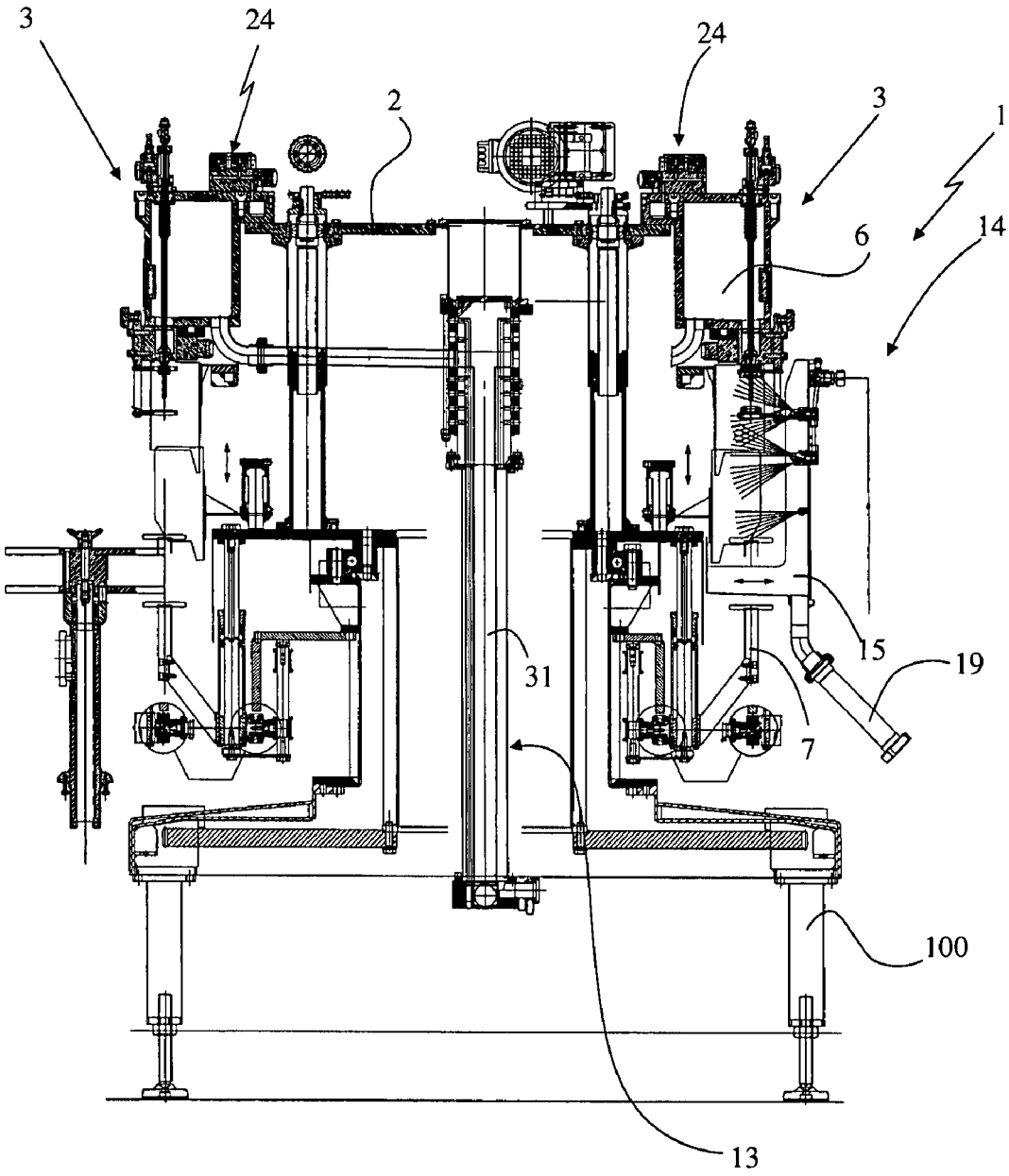
FIG. 2 shows an overall schematic side view of the filling machine according to the invention with some parts removed so that other parts may be seen more clearly.
Figure 3:
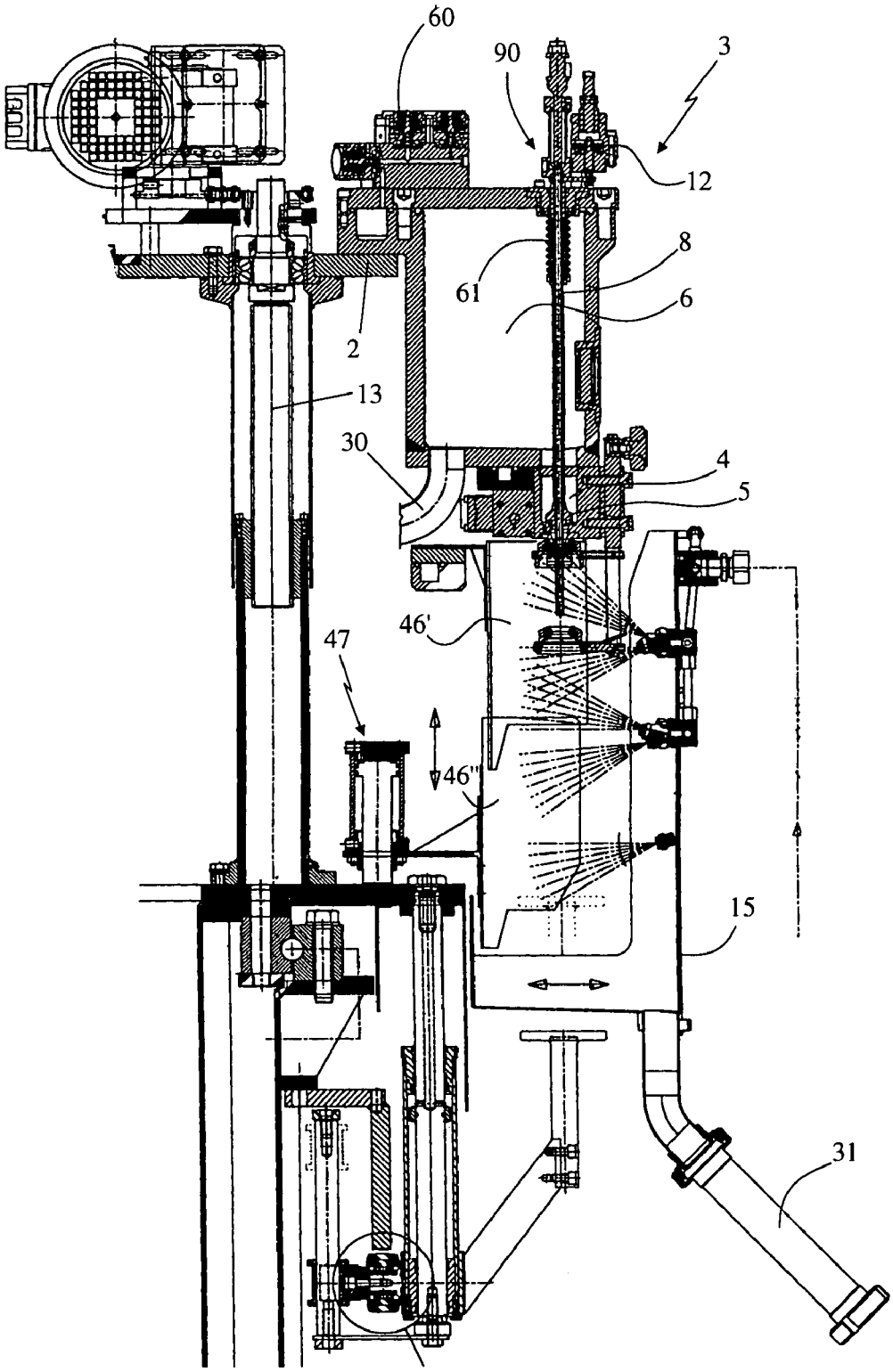
FIG. 3 shows a cross-sectioned schematic side view of an enlarged detail of the rotary filling machine, relating to a flushing station, with some parts removed so that other parts may be seen more clearly.

In accordance with the figures of the accompanying drawings, 1 denotes in it entirety the isobaric rotary filling machine according to the present invention. It is intended to perform the bottling of containers with gaseous fluids, which are generally used in the food industry, such as, for example, beverages containing carbon dioxide, sparkling wines, beer, mineral water or the like.

The machine 1 may be incorporated, in an entirely conventional manner, within a bottling plant or line equipped with several machines which work in series and in particular are provided upstream with a rinsing machine and downstream with a corking or capping machine, between which the bottles are transferred by means of conveying lines, such as, for example, conveyor belts, starwheels with compartments, feeder screws or the like.

The machine 1 comprises essentially a support structure 100 resting on the ground and able to support rotatably a rotating table 2 provided peripherally with a plurality of valve units 3 (filling heads) for transferring a gaseous liquid to be bottled from a tank 6 under pressure to underlying containers to be filled (not shown) which generally consist of glass or PET bottles.

The latter are conveyed around the machine 1, in a manner conventional per se, by a plurality of discs 7 rotating in synchronism with the valve units 3 and able to transfer the containers from an entry starwheel 9 to an exit starwheel 10.

The tank 6 is connected to a supply line 31 which has, connected along it, a valve 30 and by a pump 17 for replenishing the tank 6 with the liquid which is then transferred to the valve units 3 for filling the containers.

Each valve unit 3 has a filling duct 4 associated with first shut-off means 5 consisting of a faucet with the obturator controlled so as to open and close by means of a pneumatic actuator.

The faucets 5 regulate the flow of the liquid from the tank 6 to the container, which rotates in synchronism with the valve unit 3 supported by the disc 7. Each valve unit 3 also has a pipe 8 for the return flow of the air and for pressuring the bottle, which is mounted concentrically with the duct 4, being associated in turn with second shut-off means 60 for controlling the pressure balance between the container and the tank 6. These second shut-off means 60 preferably consist of a pneumatic valve.

The air return pipe 8 has a terminal section which is intended to be inserted inside the mouth of the container and is usually used in order to adjust the maximum level of liquid inside the container.

In greater detail, adjustment of this level may be achieved by varying mechanically the height of the pipe 8 by adjusting means 90 for the pipe 8, which are associated with its top end, as in the case envisaged in the accompanying figures. In this case, the pipe 8, upon arrival of the liquid, will cause the hydraulic closure of the air return passage. A Teflon sealing bellows 61 is also envisaged for allowing adjustable sliding of the pipe following activation of the adjusting means 90 while maintaining the sealing effect on the tank 6.

Alternatively, adjustment may be obtained by means of a pipe 8 provided with an electric probe which can be adjusted heightwise and is able to sense when the liquid reaches the required level and therefore control, in an adjustable manner, the delay in closing of the first shut-off means 5 and the second shut-off means 60. Again by way of an alternative, the level may be achieved by replacing the terminal part of the pipe depending on the form of the container and the required liquid level.

Each valve unit 3 also has a centring cone 101 against which the discs 7 bring the mouth of the containers into sealing contact.

The working height of the rotating table 2 or the tank 6 and the valve units 3 is adjusted by means of first raising means 13 so as to take into account, for example, the height of the containers.

These raising means 13 are preferably formed by a linear actuator of the mechanical type which is mounted in the central shaft for supporting and rotating the rotating table 2.

According to the idea forming the basis of the present invention, the machine 1 comprises a flushing station 14 which is situated laterally on the side of the machine 1, along a section thereof, and is operationally associated with the rotating table 2 but is fixed with respect thereto.

The abovementioned station 14 is provided with a receiving tray 15 which can be operated by movement means 16 so as to move between a non-operative position A (see FIG. 5), where it is situated outside the travel path of the valve unit 3, and an operative position B (see FIG. 6), where it is situated underneath one or more valve units 3 able to pass above it.

The receiving tray 15 may extend, preferably with a curved form, so as to embrace one or more valve units 3.

Figure 7:
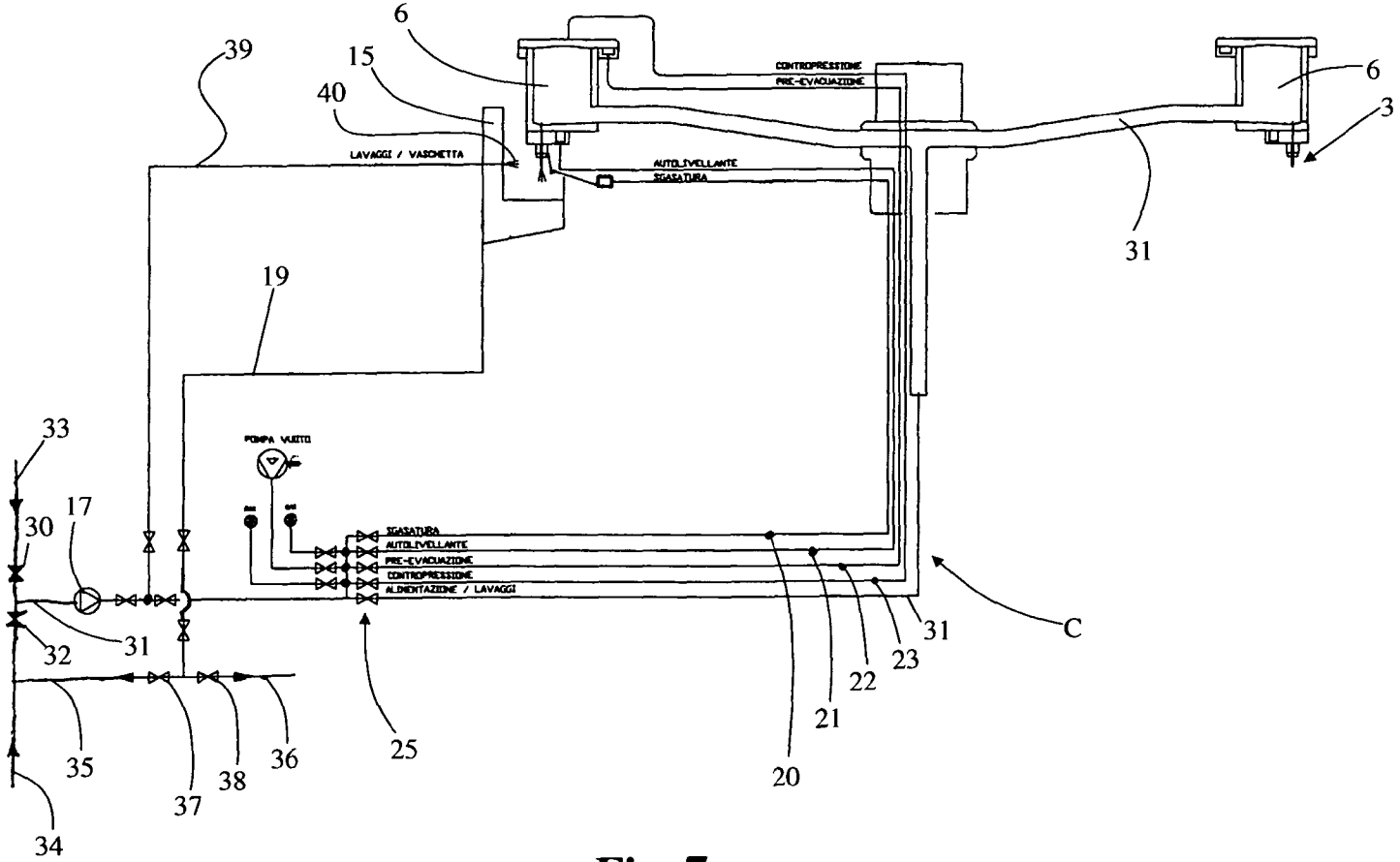
FIG. 7 shows a logic diagram of the flushing circuit.

The abovementioned flushing station 14 comprises a flushing circuit C, shown by way of example in FIG. 7, which is connected to the supply line 31 of the tank 6 via third shut-off means 32 consisting preferably also of a valve.

In the diagram according to FIG. 7, the supply lines upstream of the pump 17 for circulating the liquid to be bottled and the product to be flushed are denoted by 33 and 34.

The abovementioned flushing station 14 will be operationally used both for the flushing operations and also, as indicated further below, for performing change-over of the product to be bottled.

During flushing, with the receiving tray 15 situated in the operative position B, the machine 1 activates the circuit C so as to convey the flushing fluid to the supply line 31 of the tank 6, for this purpose the valve 32 being open and the valve 30 closed.

In this operative position B, the first and second shut-off means 5 and 60 are correspondingly open in order to allow the flushing fluid to flow into the filling ducts and into the pipes 8 of the valve units 3, situated above the receiving tray 15, so as to cause the fluid to fall into the underlying receiving tray 15 and the flushing fluid to circulate inside the flushing circuit C.

Circulation of the flushing fluid is obtained, in accordance with the diagram shown in FIG. 7, by the same pump 17 for the liquid to be bottled, which therefore also undergoes flushing.

The delivery circuit 31, which is used in order to convey the flushing fluid, is provided with branch-offs for causing the said fluid to flow also in all the operating circuits which must be flushed, the first of which being the filling duct 4 and the air return pipe 8 of each valve unit 3.

The same circuit C therefore has a return pipe 19 which removes the fluid by means of a connection provided on the bottom of the receiving tray 15 so as to direct it conveniently again into a closed circuit by means of the branch 35. The station 14 with the circuit C and the tank 15 may also perform the different function of product change-over.

In this case, it is possible to envisage causing all the valve units 3 to pass above the receiving tray 15 in order to discharge the liquid contained inside them by means of simple opening of the shut-off means 5, 60 of the filling ducts 4 and the air return pipes 8. In this case the pump 17 will be switched off and the valve 30 and the shut-off means 32 will be closed in order to supply the line 31 with the product to be bottled or with the flushing liquid, respectively.

The return line 19 will allow via the branch 36 collection of the product used in the previous bottling operations. Selection of the branch 35 and 36 for recycling the flushing product or for collecting the liquid to be bottled will be performed by means of control of the valves 37 and 38.

Before proceeding with bottling with another product it will be possible to envisage flushing of the machine aimed at preventing any contamination of the new product with the old product.

In accordance with the diagram shown in FIG. 7, the machine will allow, by means of its flushing station 14, the cleaning of numerous operating circuits which may have been soiled during operation of the machine 1.

In more detail, these operating circuits may comprise: a gas-release circuit 20 connected to each valve unit 3 for ensuring that the container is under atmospheric pressure again once filling has been completed; a self-levelling circuit 21 for correcting the liquid level inside the containers by means of the introduction of inert gas; a pre-evacuation circuit 22 for drawing the air from said containers before the introduction of said liquid with a vacuum pump; a back-pressure circuit 23 for keeping said tank 6 at a desired over-pressure with inert gas.

Each of these operating circuits 20-23 is provided with its own shut-off means—indicated overall for the sake of simplicity as fourth shut-off means 24—which, like the previous means, are controlled by the logic control unit of the machine 1 for correct operation thereof in accordance with predefined operating steps.

It should be noted that the gas-release circuit has in the conventional applications of the known type the free end which discharges into the air via a calibrated valve able to reset gradually the pressure inside the bottles to atmospheric pressure.

Differently, in accordance with an advantageous feature of the present invention, such a circuit 20 is now channelled to the tank 6 so that it may be backwashed during the flushing operations.

Advantageously, these fourth shut-off means 24 consist of a central distributor and corresponding electro-pneumatic valves which can be operated so as to open and close by a fluid under pressure and are denoted overall by 24 in the accompanying figures.

The flushing circuit C is connected by means of valves 25 to the abovementioned operating circuits 20-23 as indicated schematically in FIG. 7.

With the receiving tray 15 in the operative position B it is possible, by opening the valves 24 and 25, to flush the operating circuits.

In accordance with a secondary, but important characteristic feature of the present invention, the fluid conveyed in the operating circuits is always directed to the valve units 3 or to the tank 6 so as to cause it flow always inside the receiving tray 15 and allow recycling of the flushing product by means of the return line 19.

More particularly, flushing of the gas-release circuit 20, the self-levelling circuit 21 and the pre-evacuation circuit 22 is performed in the opposite direction to the normal flow of gas or liquid inside these circuits, resulting in better and more complete cleaning of the shut-off valves 24.

Advantageously, the flushing circuit C has a line 39 connected to a plurality of nozzles 40 mounted on the receiving tray 15 as is clearly shown in the accompanying figures.

These nozzles 40 are able to wash externally with jets 41 of flushing fluid each valve unit 3 when the latter is arranged opposite the receiving tray 15 during a flushing operation.

The nozzles 40 may be movably directed in order to wash better the valve units 3 during spraying of the flushing liquid.

Figure 5:
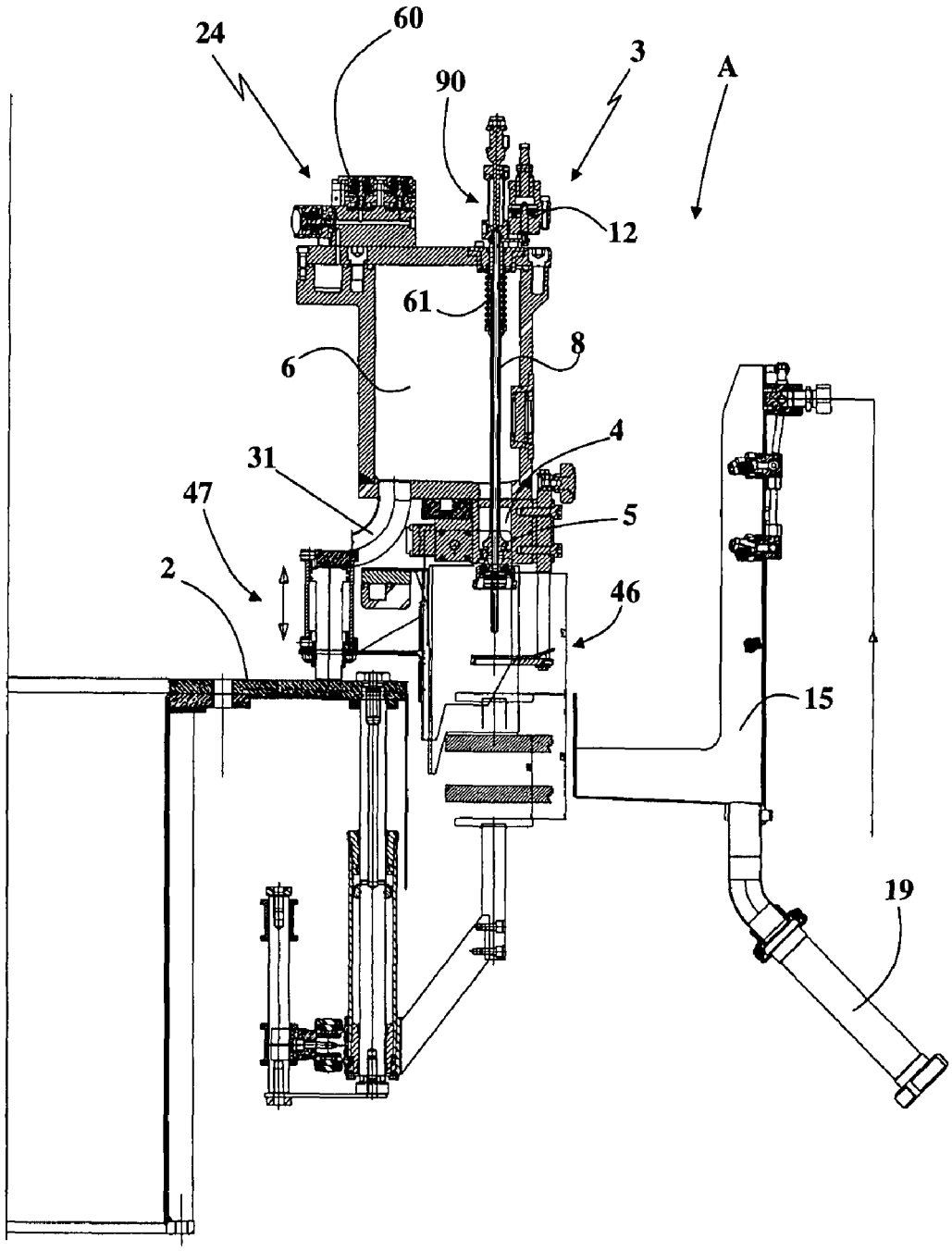
FIGS. 5 and 6 show a portion of the isobaric rotary filling machine according to the present invention in two different operating positions with respect to the flushing station.
Figure 6:
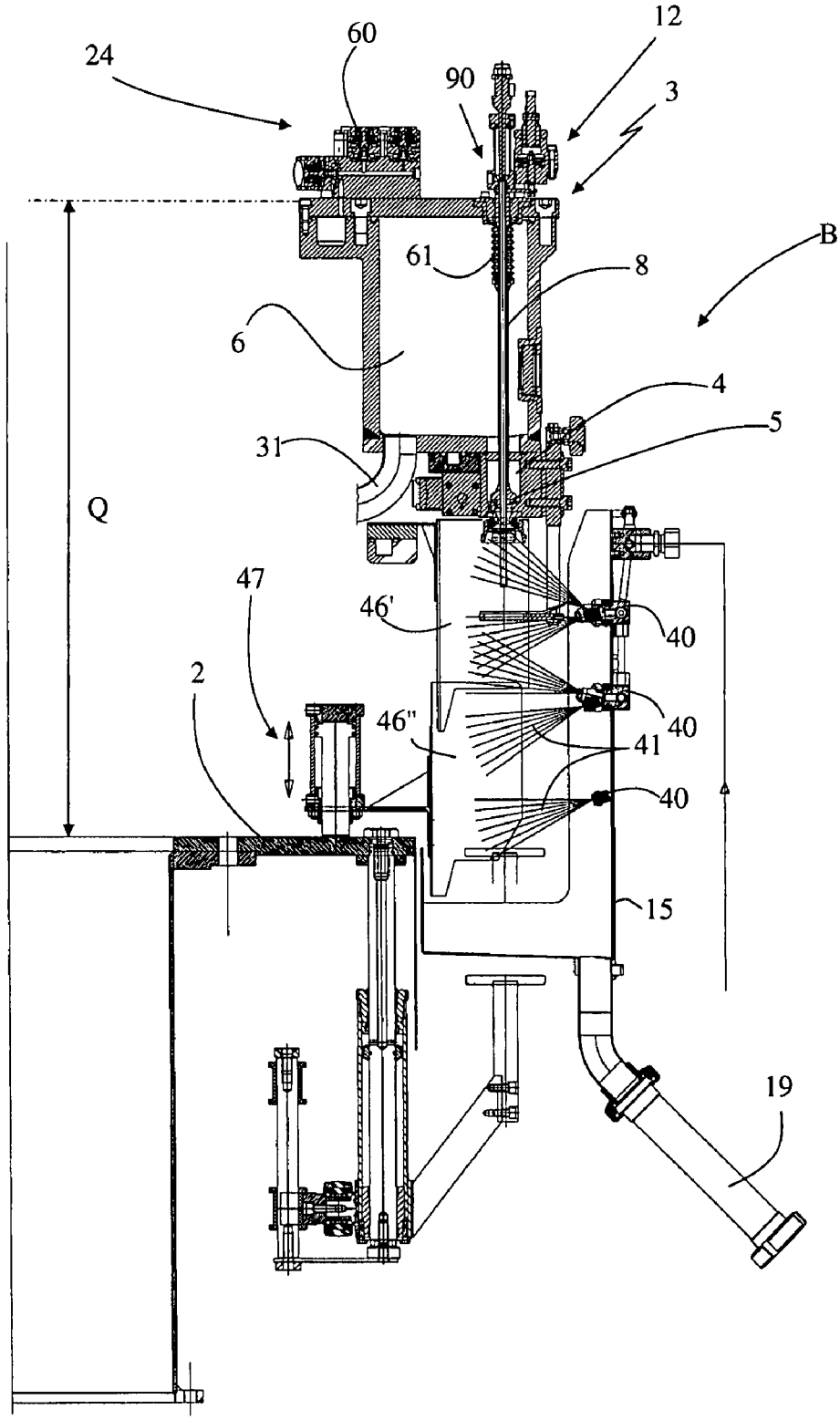

FIGS. 5 and 6 show the receiving tray in the two different positions, i.e. a non-operative position A and operative position B, which are assumed by means of activation of the movement means advantageously consisting of a linear actuator of the pneumatic type.

Figure 4:
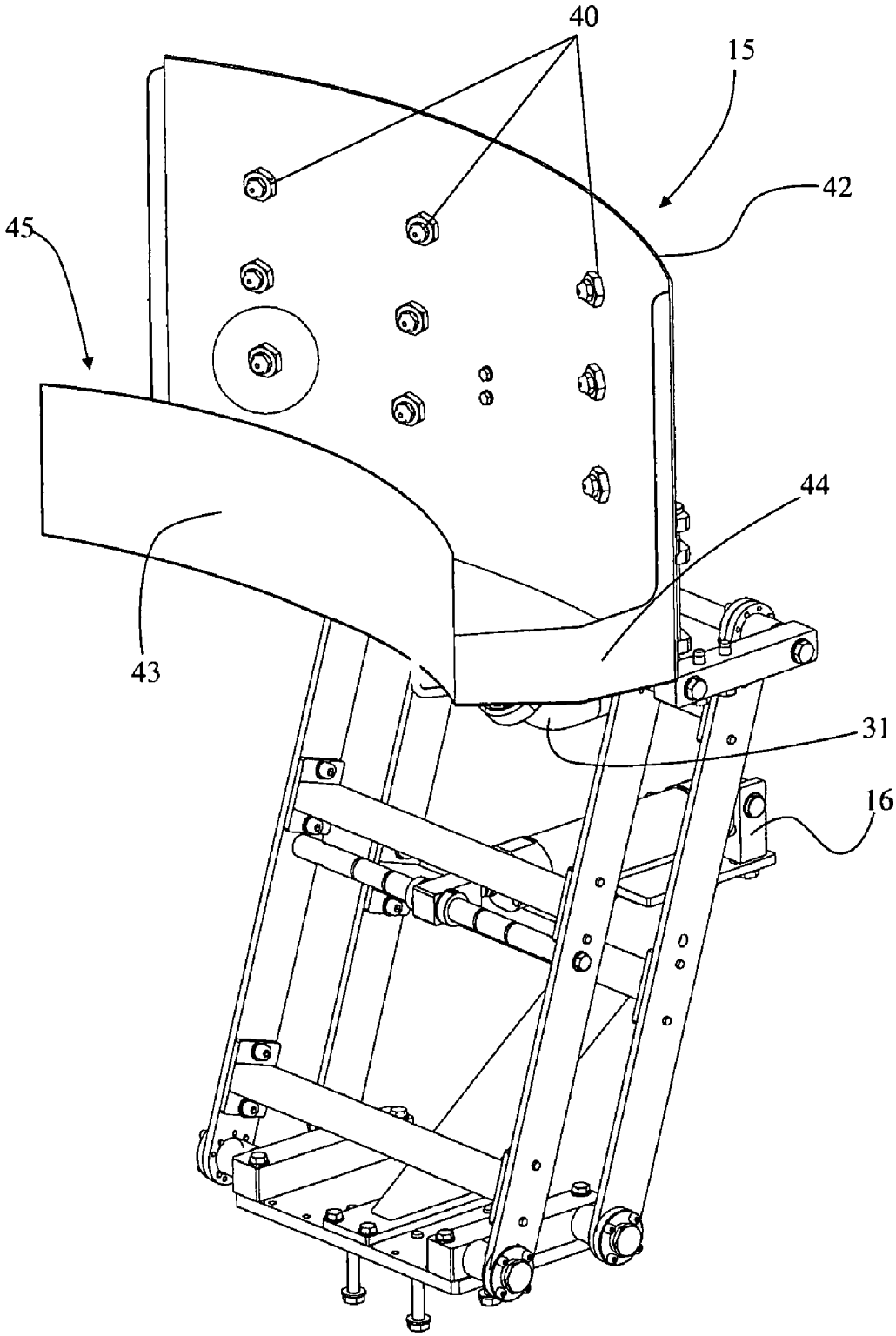
FIG. 4 shows a view of a detail of the filling machine, relating to a receiving tray of the flushing station.

The receiving tray 15 is clearly illustrated in the example of embodiment shown in FIG. 4 where 42 denotes the outer wall on which the nozzles 40 are preferably arranged in several rows at different heights and 43 denotes the inner wall which extends vertically over a height less than that of the outer wall so as to allow easy engagement thereof behind the valve unit 3.

The outer wall 42 and inner wall 43 of the tray 15 are arc-shaped so as to follow the progression of the rotating table 2 of the valve units 3. As mentioned above, the receiving tray 15 may extend over an arc having a length such as to embrace several valve units 3 and preferably three valve units 3.

The receiving tray 15 also has a front wall 44 and a real wall 45 which are provided with large openings 46 for allowing the valve units 3 to pass over the receiving tray 15 when the latter is in the operative position B.

The isobaric rotating filling machine 1 described hitherto is suitable for being used for bottling both plastic containers and glass containers.

In this latter case, however, separator cowls 46 fixed to the rotating table 2 on the sides of each valve unit 3 are usually envisaged.

In fact, isobaric rotary filling machines 1 work with the tank 6 under pressure and therefore subject the containers to a pressures which, in the event of malfunctions or defects, may cause them to break.

In the case where the containers consist of glass bottles, said breakage would be particularly dangerous, resulting in glass splinters being hurled even over a considerable distance.

These separator cowls 46 consist of plates which are generally made of metal and are able to protect the machine 1 and the operators from any glass which may be projected into the air by the sudden breakage of bottles which are not perfectly manufactured.

Also the cowls prevent the bottles from the domino effect whereby the breakage of one bottle may result in the breakage of all the others.

In accordance with a secondary, but important characteristic feature of the present invention, each separator cowl 46 is formed as two separate portions which are slidable vertically one inside the other one, a first upper portion 46' being fixed to the rotating table 2 immediately underneath the valve units 3 and a second bottom portion 46" being mounted movably on the rotating table 2.

For this purpose, second raising means 47 are provided, advantageously consisting of a linear actuator of the pneumatic type, which means are able to displace the second bottom portion 46" between two positions, i.e. a raised position for allowing insertion of the receiving tray 15 via the movement means 16 underneath the valve unit 3, and a second lowered position, where, together with the upper portion of the cowls 46', the valve units 3 are completely enclosed.

Therefore, for insertion of the receiving tray 15 underneath the valve units 3, it is necessary to raise the rotating table 2 together with the valve units 3 and the tank 6, up to a washing height, indicated by Q in FIG. 6, and then raise initially the bottom portion 46" of the cowls so as to allow insertion of the receiving tray 15 underneath the valve units 3, and then lower these bottom portions 46" of the cowls above the said receiving tray 15.

The lowered position of the bottom portions 46" of the cowls is assumed both so as to protect the machine 1 and the operators during the normal operating condition of the machine 1 and so as to allow complete washing of the cowls 46 and provide protection against the splashes of flushing product which are produced during flushing of the machine 1.

Raising of the bottom portions 46" has the function of allowing insertion of the receiving tray 15 underneath the valve units 3.

The flushing operations will advantageously be performed with an intermittent or continuous movement of the rotating table 2 so as to cause in sequence the valve units 3 to stop above the receiving tray 15 for the flushing operations.

The flushing operations therefore envisage the sequential opening of the faucets 5 above the receiving tray 15, therefore making unnecessary the insertion of dummy bottles, as in the art known to date.

Opening and closing of the valves 24 is performed by means of commands outside of the logic control unit which can be set so as to perform the desired flushing cycle, thus involving simultaneously or in successive stages the different operating circuits.

Each faucet 5 of the valve unit 3 is operated by means of a pneumatic actuator 12 which opens and closes. During normal bottling operation of the machine 1, this actuator 12 keeps the faucet 5 raised in the open condition by means of application of a pressure P1. In the event of breakage of the container the difference in pressure with respect to the tank 6 results in closing of the faucet 5 and immediate interruption in the supply of the bottling liquid. A special sensor arranged above each valve unit 3 detects this downward closing movement of the faucet 5 and causes closing of the air return pipe 8 as well as the various valves of the operating circuits for conveying air or inert gas.

The abovementioned pressure P1 of the pneumatic actuator is regulated precisely also by using a calibration spring inside the actuator 12, in view of the importance of closing safely the faucet 5 in the absence of a container or breakage of the latter.

The spring balances the weight of the faucet 5 so that supplying of a small pressure P1 causes opening thereof, while the absence or breakage of the container results in rapid closure of the faucet.

When the machine 1 performs a flushing cycle, the faucet 5 closes the filling duct 4 by means of a pressure P2>P1 able to keep the said faucet 5 stably in the open position.

Owing to the abovementioned configuration of the faucet 5 it is advantageously possible to achieve gradual filling of the container. In fact, first opening of the air return pipe 8 is performed by means of activation of the associated pneumatic valve 60 and, when the pressures inside the tank 6 and the bottle are balanced, the pneumatic actuator 12 is operated in order to open the faucet and allow descent of the liquid without it being affected by sudden variations (isopressure).

In brief, the execution of a flushing cycle of the machine 1 envisages therefore:

raising the rotating table 2 to the washing height Q;

raising the bottom portion 46" of the separator cowls 46;

displacing the receiving tray 15 into the operating position B underneath the series of valve units 3 to undergo flushing;

lowering the separator cowls 46" above the receiving tray 15;

supplying the machine 1 with the flushing fluid (valve 30 closed and valve 32 open) which washes both the duct 4 and the air return pipe 8 of the valve units 3 which have opened following operation of the first and second shut-off means 5 and 60;

supplying of the operating circuits 20-23 owing to opening of the corresponding shut-off means 25 (preferably pneumatic valves);

rotation of the rotating table 2 so as to bring another series of valve units 3 above the receiving tray 15 and start supplying of the respective circuits with flushing liquid;

at the end of the cycle, interrupting supplying of the flushing fluid and discharging into the receiving tray 15 of the flushing fluid contained in the valve units 3;

disengaging the receiving tray 15 and arranging it in the non-operative position A outside the travel path of the valve units 3.

It is emphasized that the technology introduced with the flushing station 14 for performing flushing of the machine 1 may advantageously be employed whenever it is required to change filling product and the machine 1 must therefore be completely emptied. In this case, in fact, once the supply to the tank 6 has been closed and liquid discharged from it, it is possible to discharge that part of liquid left inside the valve units 3, arranging the receiving tray 15 in the operative position and causing at least one revolution of the rotating table 2 with the ducts 4 and the air return pipe 8 which are open following operation of the first and second shut-off means 5 and 60. The liquid collected inside the tray 15 may be recycled by means of a system of pipes shown by way of example in FIG. 7 which shows precisely a possible logic diagram of the flushing fluid circuit.

The invention claimed is:

1. Isobaric rotary filling machine for filling containers, which comprises a support structure having, rotatably mounted thereon, a rotating table which supports a tank for containing a liquid gasified under pressure, which is provided with a supply pipe and a plurality of valve units which are mounted peripherally and each have: a filling duct for supplying the liquid from said tank to a container, associated with first shut-off means for controlling the flow of liquid to said container; an air return pipe, associated with second shut-off means for controlling the pressure balance between said container and said tank; first raising means able to adjust the height of said rotating table;

said machine comprising at least one flushing station operationally associated with said rotating table, but fixed with respect thereto and having at least one receiving tray connected to a flushing circuit and able to be operated by movement means so as to move between a non-operative position, where it is situated outside the travel path of said valve units, and an operative position, where it is situated underneath one or more valve units able to pass over it, said first and second shut-off means being able to perform the opening of each filling duct and each pipe with said receiving tray in the operative position and with said flushing circuit connected to said supply line of said tank, causing the liquid to fall from said one or more valve units into said receiving tray and the circulation of said flushing fluid inside said flushing circuit via at least said filling duct, said air return pipe and said receiving tray; and wherein said machine further comprises one or more of the following operating circuits: a gas-release circuit connected to each valve unit for ensuring that the container is under atmospheric pressure again at the end of filling; a self-levelling circuit for reaching the desired liquid level inside the containers; a pre-evacuation circuit for drawing the air from said containers prior to the introduction of said liquid; a back-pressure circuit for keeping said tank at a desired overpressure; wherein each of said one or more operating circuits is provided with corresponding fourth shut-off means which can be actuated so to open with said receiving tray in the operative position so as to cause the circulation of said flushing fluid of said flushing circuit through said at least one operating circuit.

2. Machine according to claim 1, wherein each of said fourth shut-off means associated with one of said operating circuits is formed by a valve operated by a fluid under pressure so as to allow the flow of the flushing fluid with the receiving tray in the operative position.

3. Machine according to claim 2, wherein said receiving tray has a plurality of nozzles connected to said flushing circuit and able to wash externally with jets of flushing fluid each of said valve units when the latter are arranged opposite said receiving tray.

4. Machine according to claim 3, wherein said receiving tray is bounded by an outer wall having, associated therewith, said plurality of nozzles and by an inner wall having a height less than said outer wall.

5. Machine according to claim 4, wherein said inner and outer walls of said tray are arc-shaped so as to be positioned underneath one or more valve units.

6. Machine according to claim 3, wherein said receiving tray has a front wall and a rear wall provided with large openings for allowing the valve units to pass through with said tray in the operative position.

7. Machine according to claim 1, wherein said movement means comprise at least one linear actuator able to displace said tray between said operative position and said non-operative position.

8. Machine according to claim 1, wherein said receiving tray, when it is arranged in the operative position, is able to receive the part of the liquid left inside said valve units at a height less than the discharge outlet of said storage tank, said first shut-off means being for this purpose open during the passing movement of each valve unit above said receiving tray.

9. Machine according to claim 1, wherein said flushing fluid which flows inside said flushing circuit through said operating circuits is conveyed to said valve units and/or to said tank so as to then fall inside said receiving tray.

10. Isobaric rotary filling machine for filling containers, which comprises a support structure having, rotatably mounted thereon, a rotating table which supports a tank for containing a liquid gasified under pressure, which is provided with a supply pipe and a plurality of valve units which are mounted peripherally and each have: a filling duct for supplying the liquid from said tank to a container, associated with first shut-off means for controlling the flow of liquid to said container; an air return pipe, associated with second shut-off means for controlling the pressure balance between said container and said tank; first raising means able to adjust the height of said rotating table;

said machine comprising at least one flushing station operationally associated with said rotating table, but fixed with respect thereto and having at least one receiving tray connected to a flushing circuit and able to be operated by movement means so as to move between a non-operative position, where it is situated outside the travel path of said valve units, and an operative position, where it is situated underneath one or more valve units able to pass over it, said first and second shut-off means being able to perform the opening of each filling duct and each pipe with said receiving tray in the operative position and with said flushing circuit connected to said supply line of said tank, causing the liquid to fall from said one or more valve units into said receiving tray and the circulation of said flushing fluid inside said flushing circuit via at least said filling duct, said air return pipe and said receiving tray; and wherein said machine further comprises separator cowls situated on the sides of said valve units and each formed as two portions sliding vertically with respect to each other, a first portion being fixed to the rotating table underneath the valve units and a second portion being mounted movably on the rotating platform and being able to be displaced by second raising means between two positions, i.e. a first raised position for allowing the insertion of said receiving tray via said movement means underneath said valve units, and a second lowered position for enclosing the valve units, assumed during said flushing.

* * * * *